US008824722B2

(12) United States Patent
Wang et al.

(10) Patent No.: US 8,824,722 B2
(45) Date of Patent: Sep. 2, 2014

(54) LOUDSPEAKER INCORPORATING CARBON NANOTUBES

(75) Inventors: Jia-Ping Wang, Beijing (CN); Liang Liu, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 433 days.

(21) Appl. No.: 12/824,430

(22) Filed: Jun. 28, 2010

(65) Prior Publication Data

US 2011/0317866 A1 Dec. 29, 2011

(51) Int. Cl.
*H04R 1/02* (2006.01)
*H04R 9/04* (2006.01)

(52) U.S. Cl.
CPC ..... *H04R 9/046* (2013.01)
USPC ..... 381/394; 381/386; 381/407; 381/423

(58) Field of Classification Search
CPC .. H04R 9/046; H04R 9/043; H04R 2307/025; H04R 1/00; H04R 2307/023; H04R 3/00; H04R 7/02; H04R 9/02; H04R 31/003; H04R 7/125; H04R 2400/07; H04R 31/006; H04R 7/14; H04R 1/06; H04R 2307/027; H04R 2307/029; H04R 7/00
See application file for complete search history.

(56) References Cited

U.S. PATENT DOCUMENTS

| | | | | |
|---|---|---|---|---|
| 4,312,118 | A | 1/1982 | Saik et al. | |
| 6,808,746 | B1 | 10/2004 | Dai et al. | |
| 7,045,108 | B2 | 5/2006 | Jiang et al. | |
| 7,437,938 | B2 | 10/2008 | Chakraborty | |
| 7,483,545 | B2 * | 1/2009 | Nagaoka | 381/423 |
| 7,570,780 | B2 * | 8/2009 | Baeten | 381/423 |
| 7,856,115 | B2 * | 12/2010 | Clair et al. | 381/404 |
| 2004/0020681 | A1 | 2/2004 | Hjortstam et al. | |
| 2004/0053780 | A1 | 3/2004 | Jiang et al. | |
| 2004/0197006 | A1 * | 10/2004 | Suzuki et al. | 381/410 |
| 2006/0008111 | A1 * | 1/2006 | Nagaoka | 381/423 |
| 2006/0137935 | A1 * | 6/2006 | Nevill | 181/174 |
| 2006/0147081 | A1 | 7/2006 | Mango, III et al. | |
| 2007/0166223 | A1 | 7/2007 | Jiang et al. | |
| 2007/0200467 | A1 * | 8/2007 | Heydt et al. | 310/800 |
| 2008/0248235 | A1 | 10/2008 | Feng et al. | |
| 2008/0299031 | A1 | 12/2008 | Liu et al. | |
| 2008/0304694 | A1 | 12/2008 | Hayashi | |

(Continued)

FOREIGN PATENT DOCUMENTS

| | | |
|---|---|---|
| CN | 2488247 | 4/2002 |
| CN | 1430785 | 7/2003 |

(Continued)

OTHER PUBLICATIONS

Xiao et al.,Flexible, Stretchable, Transparent Carbon Nanotube Thin Film Loudspeakers,Nanoletter, vol. 8; No. 12, 4539-4545.

*Primary Examiner* — Marlon Fletcher
(74) *Attorney, Agent, or Firm* — Novak Druce Connolly Bove + Quigg LLP

(57) ABSTRACT

A diaphragm includes a diaphragm and a voice coil bobbin. The diaphragm includes a membrane and a first reinforcing structure reinforcing the membrane. The voice coil bobbin includes a base and a second reinforcing structure reinforcing the base. The first reinforcing structure and the second reinforcing structure are a carbon nanotube structure. The carbon nanotube structure is disposed on the membrane and the base, or in the membrane and the base.

19 Claims, 22 Drawing Sheets

(56) References Cited

U.S. PATENT DOCUMENTS

| | | | | |
|---|---|---|---|---|
| 2009/0013792 | A1 | 1/2009 | Qiao et al. | |
| 2009/0045005 | A1 | 2/2009 | Byon et al. | |
| 2009/0068448 | A1 | 3/2009 | Liu et al. | |
| 2009/0074228 | A1 | 3/2009 | Mango, III et al. | |
| 2009/0117434 | A1 | 5/2009 | Liu et al. | |
| 2009/0129624 | A1* | 5/2009 | Nagaoka | 381/424 |
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |
| 2009/0169463 | A1 | 7/2009 | Smalley et al. | |
| 2009/0197082 | A1 | 8/2009 | Jiang et al. | |
| 2009/0220767 | A1 | 9/2009 | Schlogl et al. | |
| 2009/0272935 | A1 | 11/2009 | Hata et al. | |
| 2010/0013356 | A1* | 1/2010 | Heydt et al. | 310/334 |
| 2010/0046784 | A1* | 2/2010 | Jiang et al. | 381/386 |

FOREIGN PATENT DOCUMENTS

| | | | |
|---|---|---|---|
| CN | 2583909 | Y | 10/2003 |
| CN | 1568636 | A | 1/2005 |
| CN | 1640923 | | 7/2005 |
| CN | 1982209 | A | 6/2007 |
| CN | 101061750 | | 10/2007 |
| CN | 101061750 | A | 10/2007 |
| CN | 101239712 | | 8/2008 |
| CN | 101288336 | | 10/2008 |
| CN | 101288336 | A | 10/2008 |
| CN | 101304945 | | 11/2008 |
| CN | 101321410 | | 12/2008 |
| CN | 101381071 | | 3/2009 |
| CN | 101464759 | | 6/2009 |
| CN | 101464759 | A | 6/2009 |
| CN | 101497435 | A | 8/2009 |
| JP | 60-27298 | | 2/1985 |
| JP | 63-49991 | | 12/1988 |
| JP | 7-138838 | | 5/1995 |
| JP | 2002-171593 | | 6/2002 |
| JP | 2002171593 | | 6/2002 |
| JP | 2002-542136 | | 12/2002 |
| JP | 2003-319490 | | 11/2003 |
| JP | 2003319490 | | 11/2003 |
| JP | 2004-32425 | | 1/2004 |
| JP | 2004032425 | | 1/2004 |
| JP | 2004-107196 | | 4/2004 |
| JP | 2006-147801 | | 6/2006 |
| JP | 2006147801 | | 6/2006 |
| JP | 2007-182352 | | 7/2007 |
| JP | 2007-290908 | | 11/2007 |
| JP | 2009-144158 | | 7/2009 |
| JP | 2009-146420 | | 7/2009 |
| JP | 2009144158 | | 7/2009 |
| JP | 2009-184910 | | 8/2009 |
| TW | 200904742 | | 2/2009 |
| WO | W02007015710 | | 2/2007 |

* cited by examiner

LOUDSPEAKER INCORPORATING CARBON NANOTUBES

BACKGROUND

1. Technical Field

The present disclosure relates to loudspeakers and, particularly, to a loudspeaker incorporating carbon nanotubes.

2. Description of Related Art

A loudspeaker is an acoustic device transforming received electric signals into sounds. There are different types of loudspeakers that can be categorized by their working principle, such as electro-dynamic loudspeakers, electromagnetic loudspeakers, electrostatic loudspeakers, and piezoelectric loudspeakers. Among the various types, the electro-dynamic loudspeakers have simple structures, good sound qualities, low costs, and are most widely used.

The electro-dynamic loudspeaker typically includes a diaphragm, a bobbin, a voice coil, a damper, a magnet, and a frame. The voice coil is an electrical conductor placed in the magnetic field of the magnet. By applying an electrical current to the voice coil, a mechanical vibration of the diaphragm is produced due to the interaction between the electromagnetic field produced by the voice coil and the magnetic field of the magnets, thus producing sound waves by kinetically pushing the air. The diaphragm reproduces sound pressure waves corresponding to the input electric signals.

Sound quality is an important factor that must be taken into account in loudspeaker design. In loudspeakers, diaphragms and bobbins may affect sound quality. The increasing demand for loudspeakers capable of producing high-quality sounds has led to a demand for diaphragms and bobbins having better physical properties than conventional diaphragms and bobbins.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
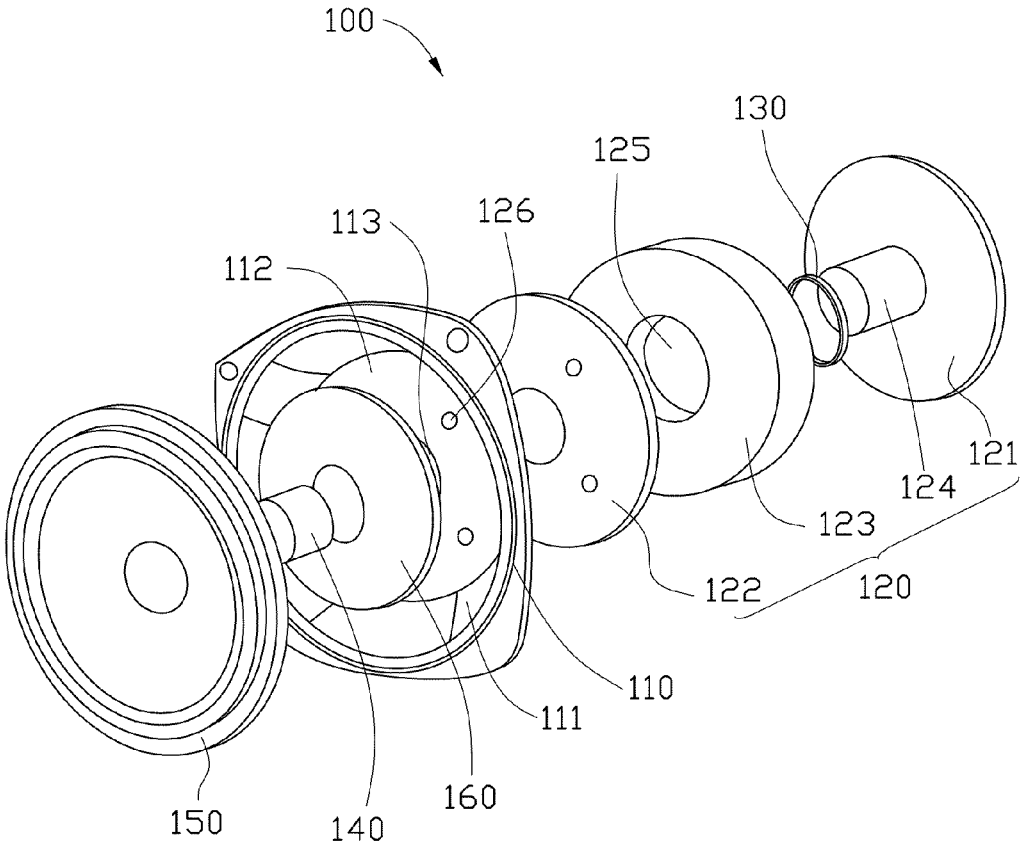
FIG. 1 is a schematic structural view of an embodiment of a loudspeaker.
Figure 2:
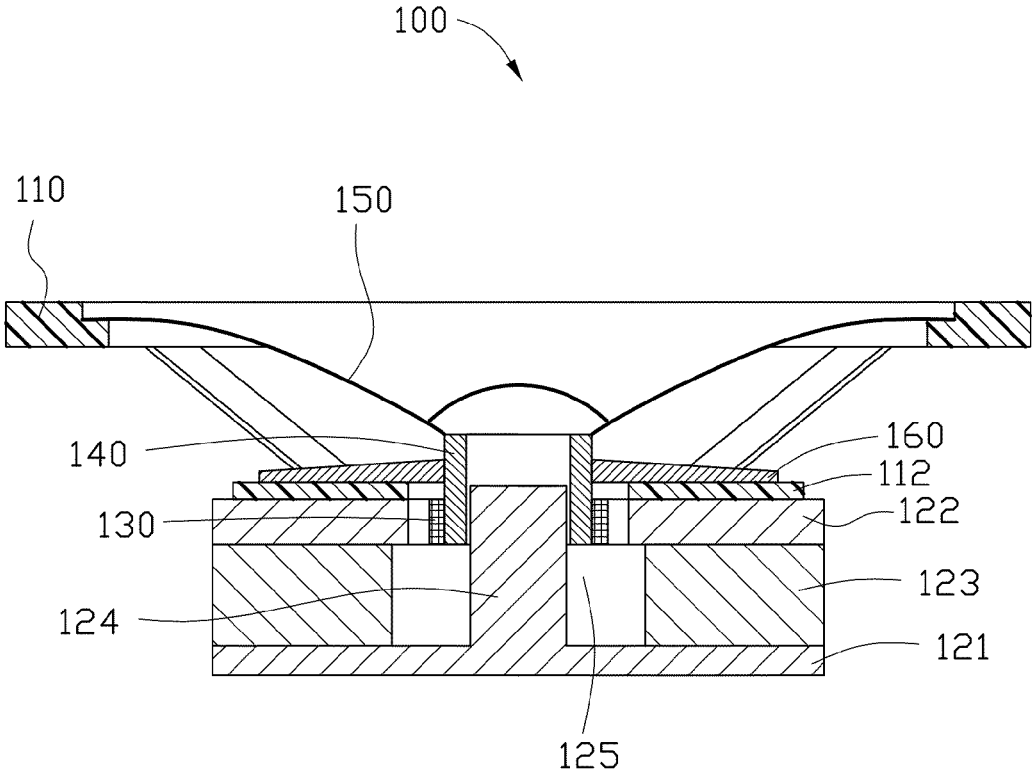
FIG. 2 is a cross-sectional view of the loudspeaker of FIG. 1 after being assembled.

Referring to FIGS. 1 and 2, a loudspeaker 100 of one embodiment is shown. The loudspeaker 100 includes a frame 110, a magnetic circuit 120, a voice coil 130, a voice coil bobbin 140, a diaphragm 150 and a damper 160.

The frame 110 can have a structure of a truncated cone with an opening (not labeled) on one end. The frame 110 has a bottom 112 and a hollow cavity 111. The hollow cavity 111 receives the diaphragm 150 and the damper 160. The bottom 112 has a center hole 113. The bottom 112 of the frame 110 is fixed to the magnetic circuit 120.

The magnetic circuit 120 includes a lower plate 121, an upper plate 122, a magnet 123, and a magnet core 124. The magnet 123 is disposed between the upper plate 122 and the lower plate 121. The upper plate 122 and the magnet 123 are both substantially ring shaped, and define a substantially cylindrical shaped magnetic gap 125 in the magnetic circuit 120. The magnet core 124 is fixed on the lower plate 121 received in the magnetic gap 125, and extends through the center hole 113 of the bottom 112. The magnetic circuit 120 is fixed on the bottom 112 via the upper plate 122. The upper plate 122 can be combined with the bottom 112 via adhesive or mechanical force. In one embodiment according to FIG. 1, the upper plate 122 is fixed on the bottom 112 by screws (not shown) via screw holes 126.

The diaphragm 150 is a sound producing member of the loudspeaker 100. The diaphragm 150 can have a conical shape if used in a large sized loudspeaker 100. If the loudspeaker 100 has a smaller size, the diaphragm 150 can have a planar circular shape or a planar rectangular shape. A material of the diaphragm 150 can be aluminum alloy, magnesium alloy, ceramic, fiber, or cloth. In one embodiment according to FIG. 1, the diaphragm 150 has a conical shape. The diaphragm 150 includes an outer rim (not labeled) and an inner rim (not labeled). The outer rim of the diaphragm 150 is fixed to the opening end of the frame 110, and the inner rim of the diaphragm 150 is fixed to the voice coil bobbin 140. Furthermore, an external input terminal (not shown) can be attached to the frame 110. A dust cap can be fixed over and above a joint portion of the diaphragm 150 and the voice coil bobbin 140.

The damper 160 holds the diaphragm 150 mechanically. The damper 160 is fixed to the bottom 112 of the frame 110. An inner rim of the damper 160 is connected with the voice coil bobbin 140. The damper 160 has a relatively high rigidity along the radial direction thereof, and a relatively low rigidity along the axial direction thereof, thus allows the voice coil bobbin 140 can freely move up and down but not radially.

The voice coil 130 is a driving member of the loudspeaker 100. The voice coil 130 is disposed around an outer surface of the bobbin 140. When an electric signal is inputted into the voice coil 130, a magnetic field is formed by the voice coil 130 as the variation of the electric signals. The interaction of the magnetic filed caused by the voice coil 130 and the magnetic circuit 120 produces the vibration of the voice coil 130. The vibration of the voice coil 130 would make the voice coil bobbin 140 vibrate, and accordingly the diaphragm 150 fixed on the voice coil bobbin 140 will vibrate. The vibration of the diaphragm 150 causes the loudspeaker 100 to produce sound.

In the loudspeaker 100, the diaphragm 150 and the voice coil bobbin 140 comprise at least one carbon nanotube structure.

Carbon Nanotube Structure

The carbon nanotube structure can include a plurality of carbon nanotubes uniformly distributed therein and combined by van der Waals attractive force therebetween. The carbon nanotubes in the carbon nanotube structure can be orderly or disorderly arranged. The term 'disordered carbon nanotube structure' includes, but is not limited to, a structure where the carbon nanotubes are arranged along many different directions, such that the number of carbon nanotubes arranged along each different direction can be almost the same (e.g. uniformly disordered) and/or entangled with each other. 'Ordered carbon nanotube structure' includes, but is not limited to, a structure where the carbon nanotubes are arranged in a systematic manner, e.g., the carbon nanotubes can be arranged approximately along a same direction and or have two or more sections within each of which the carbon nanotubes are arranged approximately along a same direction (different sections can have different directions).

The carbon nanotubes in the carbon nanotube structure can be single-walled, double-walled, and/or multi-walled carbon nanotubes. The diameters of the single-walled carbon nanotubes can range from about 0.5 nanometers to about 50 nanometers. The diameters of the double-walled carbon nanotubes can range from about 1 nanometer to about 50 nanometers. The diameters of the multi-walled carbon nanotubes can range from about 1.5 nanometers to about 50 nanometers.

In some embodiments, the carbon nanotube structure comprises at least one carbon nanotube film, at least one linear carbon nanotube structure, or a combination of the at least one carbon nanotube film and the at least one linear carbon nanotube structure. In combination, the at least one linear carbon nanotube structure can be disposed on a surface of the at least one carbon nanotube film with adhesives or by heat pressing.

Carbon Nanotube Film

The at least one carbon nanotube film can be a drawn carbon nanotube film, a flocculated carbon nanotube film, or a pressed carbon nanotube film.

Drawn Carbon Nanotube Film

Figure 3:
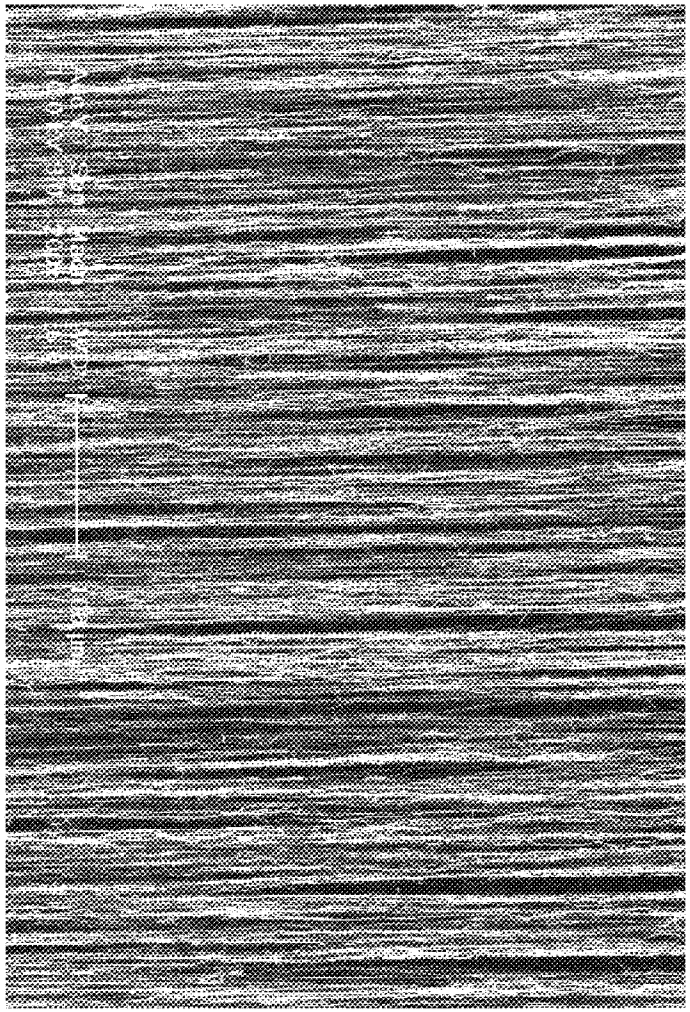
FIG. 3 shows a Scanning Electron Microscope (SEM) image of a drawn carbon nanotube film.
Figure 4:
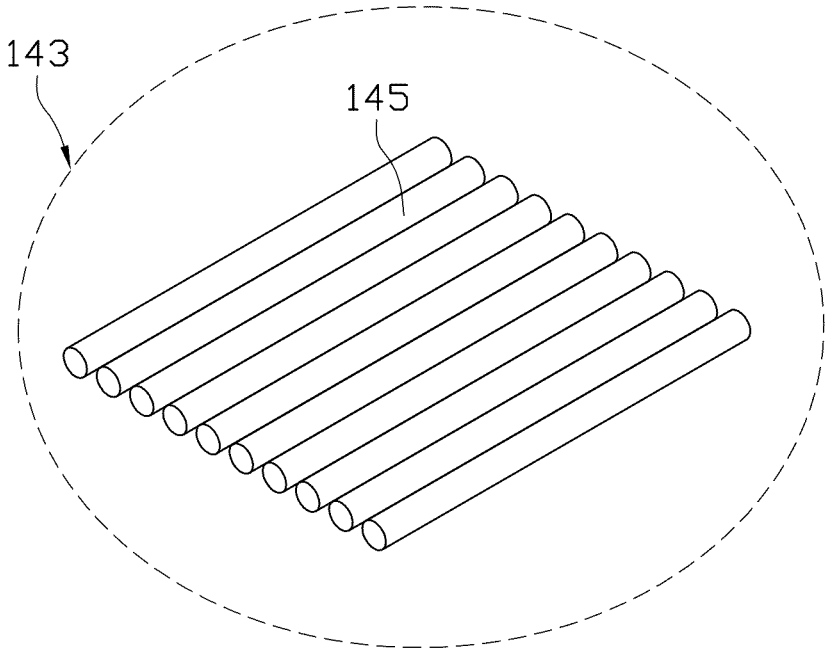
FIG. 4 is a schematic, enlarged view of a carbon nanotube segment in the drawn carbon nanotube film of FIG. 3.

In one embodiment, the carbon nanotube structure can include at least one drawn carbon nanotube film. Examples of a drawn carbon nanotube film are taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array capable of having a film drawn therefrom. Referring to FIGS. 3 and 4, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 substantially parallel to each other, and combined by van der Waals attractive force therebetween. As can be seen in FIG. 3, some variations can occur in the drawn carbon nanotube film. The carbon nanotubes 145 in the drawn carbon nanotube film are also oriented along a preferred orientation.

The carbon nanotube structure also can include at least two stacked drawn carbon nanotube films. In other embodiments, the carbon nanotube structure can include two or more coplanar drawn carbon nanotube films. Coplanar drawn carbon nanotube films can also be stacked upon other coplanar films. Additionally, an angle can exist between the orientation of carbon nanotubes in adjacent drawn films, stacked and/or coplanar. Adjacent drawn carbon nanotube films can be combined by only the van der Waals attractive force therebetween without the need of an additional adhesive. An angle between the aligned directions of the carbon nanotubes in the two adjacent drawn carbon nanotube films can range from 0 degrees to about 90 degrees. If the angle between the aligned directions of the carbon nanotubes in adjacent drawn carbon nanotube films is larger than 0 degrees, a microporous structure is defined by the carbon nanotubes. The carbon nanotube structure in one embodiment employing these films will have a plurality of micropores. The sizes of the micropores can be less than about 10 μm.

Flocculated Carbon Nanotube Film

Figure 5:
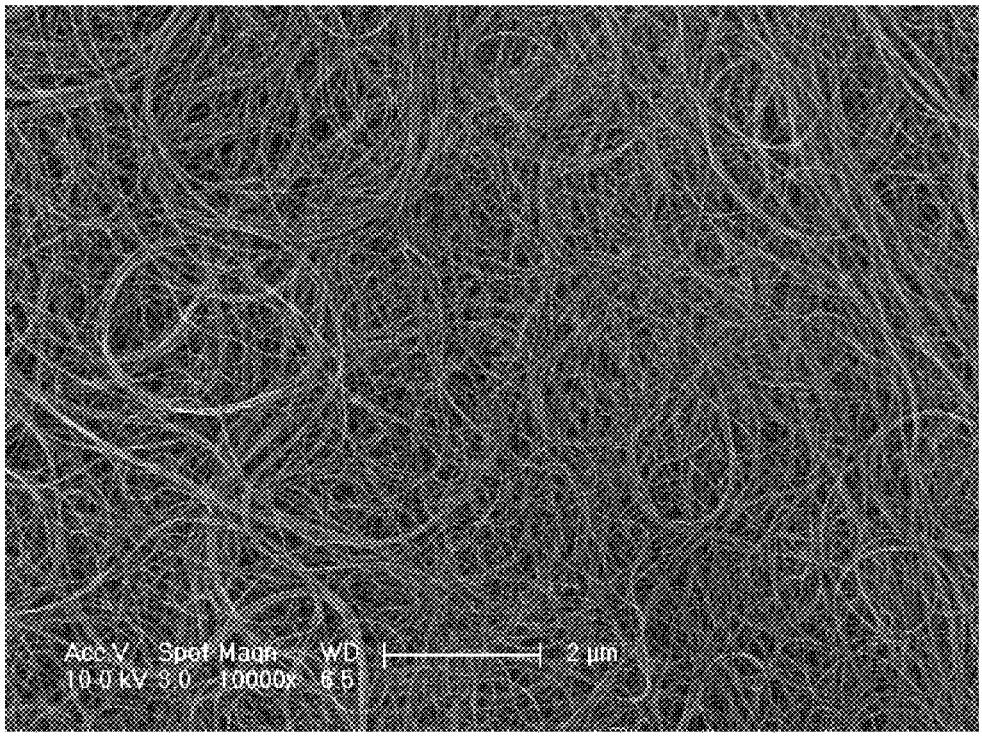
FIG. 5 shows an SEM image of a flocculated carbon nanotube film.

In other embodiments, the carbon nanotube structure can include a flocculated carbon nanotube film. Referring to FIG. 5, the flocculated carbon nanotube film can include a plurality of long, curved, disordered carbon nanotubes entangled with each other. Further, the flocculated carbon nanotube film can be isotropic. The carbon nanotubes can be substantially uniformly dispersed in the carbon nanotube film. Adjacent carbon nanotubes are acted upon by van der Waals attractive force to obtain an entangled structure with micropores defined therein. It is understood that the flocculated carbon nanotube film is very porous. The sizes of the micropores can be less than about 10 μm. The porous nature of the flocculated carbon nanotube film will increase the specific surface area of the carbon nanotube structure. Because the carbon nanotubes in the carbon nanotube structure are entangled with each other, the carbon nanotube structure employing the flocculated carbon nanotube film has excellent durability, and can be fashioned into desired shapes with a low risk to the integrity of the carbon nanotube structure. The thickness of the flocculated carbon nanotube film can range from about 1 μm to about 1 mm.

Pressed Carbon Nanotube Film

Figure 6:
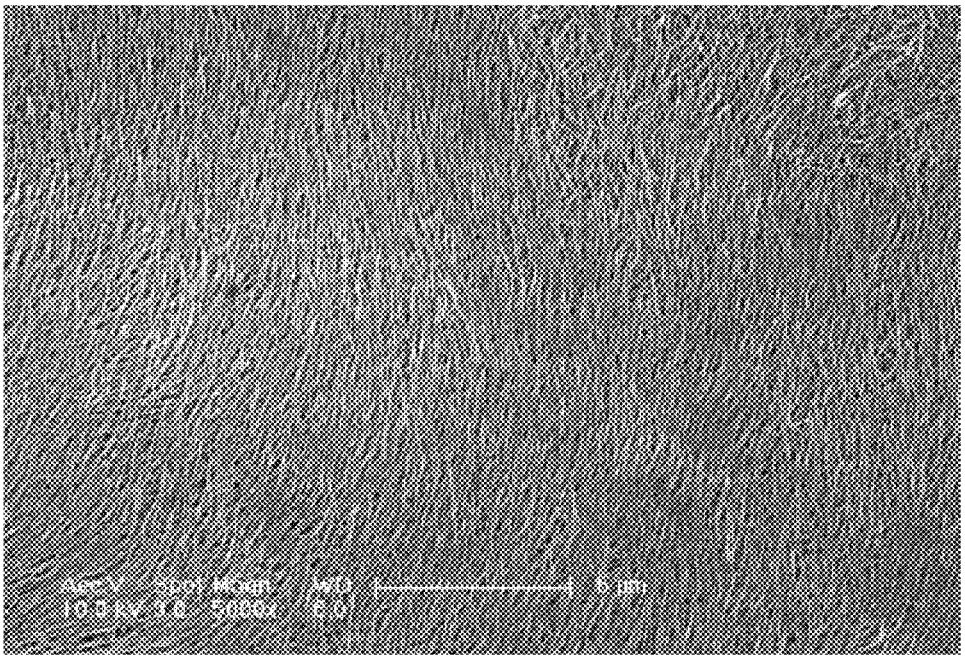
FIG. 6 shows an SEM image of a pressed carbon nanotube film.

In other embodiments, the carbon nanotube structure can include at least a pressed carbon nanotube film. Referring to FIG. 6, the pressed carbon nanotube film can be a free-standing carbon nanotube film. The carbon nanotubes in the pressed carbon nanotube film are arranged along a same direction or along different directions. The carbon nanotubes in the pressed carbon nanotube film can rest upon each other. Adjacent carbon nanotubes are attracted to each other and combined by van der Waals attractive force. An angle between a primary alignment direction of the carbon nanotubes and a surface of the pressed carbon nanotube film is about 0 degrees to approximately 15 degrees. The greater the pressure applied, the smaller the angle obtained. If the carbon nanotubes in the pressed carbon nanotube film are arranged along different directions, the carbon nanotube structure can be isotropic. Here, "isotropic" means the carbon nanotube film has properties identical in all directions substantially parallel to a surface of the carbon nanotube film. The thickness of the pressed carbon nanotube film can range from about 0.5 nm to about 1 mm. Examples of a pressed carbon nanotube film are taught by US PGPub. 20080299031A1 to Liu et al.

Linear Carbon Nanotube Structure

The linear carbon nanotube structure can include one or more carbon nanotube wires. The carbon nanotube wires in the linear carbon nanotube structure can be substantially parallel to each other to form a bundle-like structure or twisted with each other to form a twisted structure.

Figure 7:
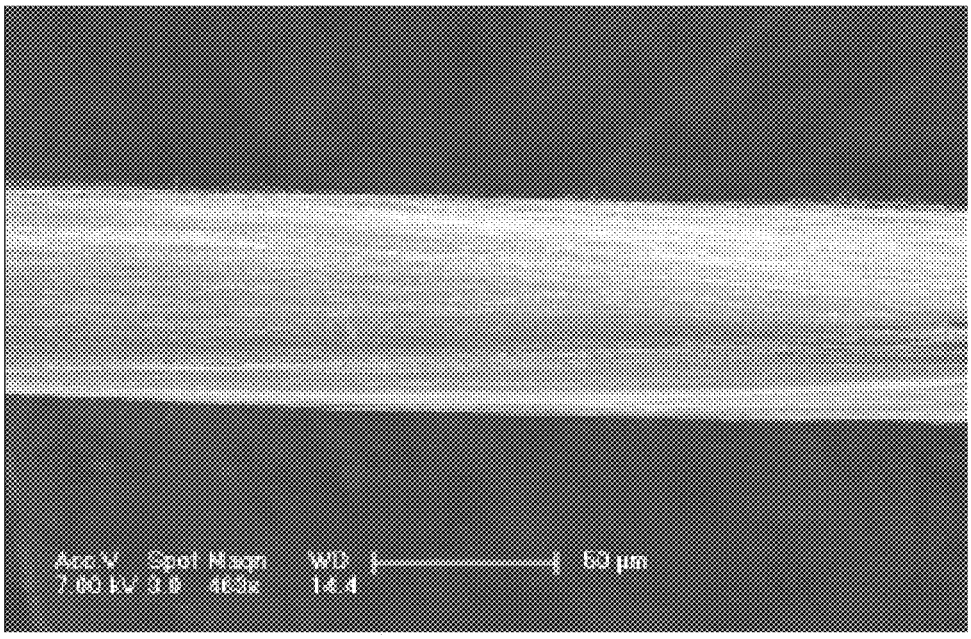
FIG. 7 is an SEM image of an untwisted carbon nanotube wire.

The carbon nanotube wire can be an untwisted carbon nanotube wire or a twisted carbon nanotube wire. An untwisted carbon nanotube wire is formed by treating a carbon nanotube film with an organic solvent. FIG. 7 shows an untwisted carbon nanotube wire including a plurality of successive carbon nanotubes substantially oriented along the linear direction of the untwisted carbon nanotube wire and joined end-to-end by van der Waals attraction force therebetween. The untwisted carbon nanotube wire can have a diameter ranging from about 0.5 nm to about 100 μm.

Figure 8:
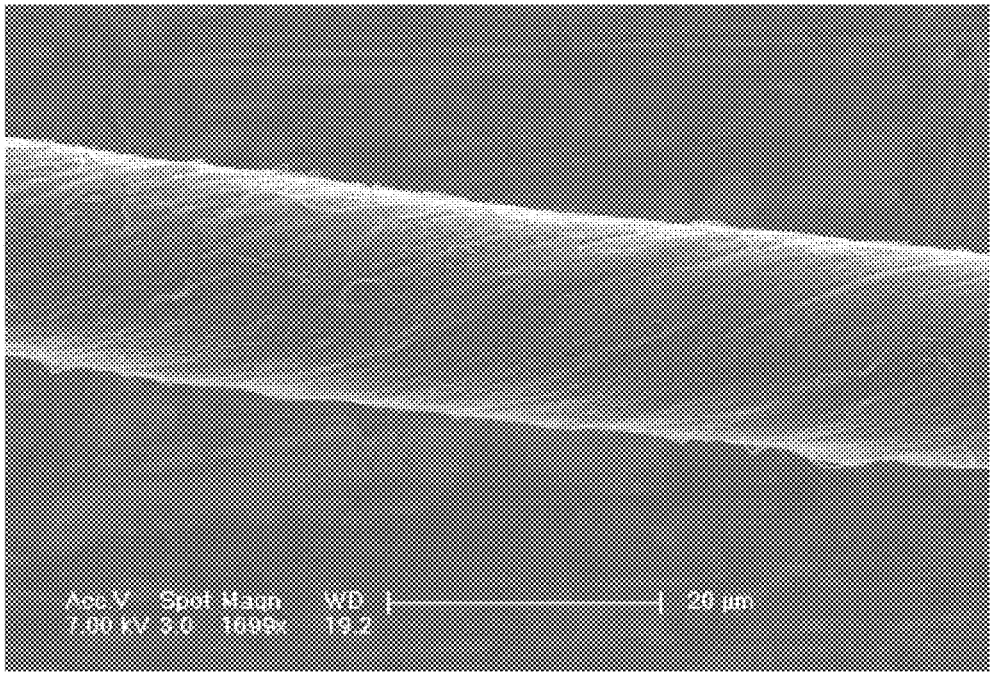
FIG. 8 is an SEM image of a twisted carbon nanotube wire.

A twisted carbon nanotube wire can be formed by twisting a carbon nanotube film using a mechanical force. FIG. 8 shows a twisted carbon nanotube wire including a plurality of carbon nanotubes oriented around an axial direction of the twisted carbon nanotube wire. The length of the twisted carbon nanotube wire can be set as desired and the diameter of the carbon nanotube wire can range from about 0.5 nanometers to about 100 micrometers. The twisted carbon nanotube wire can be treated with an organic solvent before or after twisting.

Example 1

Carbon Nanotube Structure on Diaphragm and Voice Coil Bobbin

Figure 9:
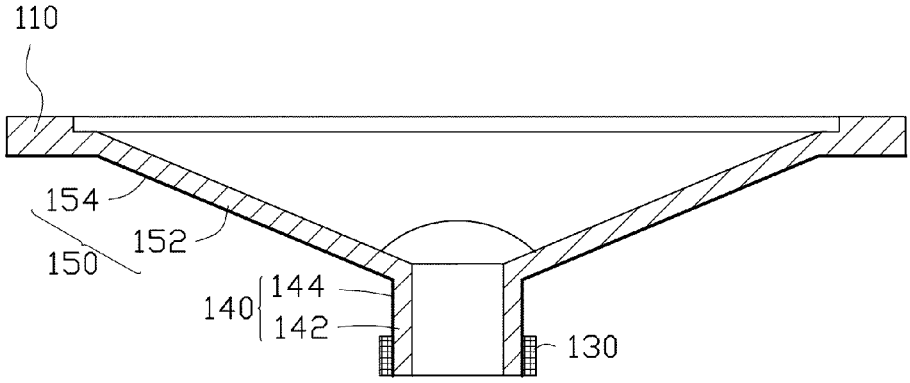
FIG. 9 is a schematic cross-sectional view of a diaphragm and a voice coil bobbin with a voice coil mounted thereon.

In this example, the diaphragm 150 and the voice coil bobbin 140 comprise at least one carbon nanotube structure. As shown in FIG. 9, the diaphragm 150 comprises a membrane 152 and a first reinforcing structure 154 on the membrane 152. The voice coil bobbin 140 comprises a base 142 and a second reinforcing structure 144 on the base 142.

The membrane 152 can be a conical diaphragm, bulletproof cloth diaphragm, polypropylene diaphragm, or carbon fiber diaphragm. The material of the membrane 152 can be metal, diamond, ceramic, paper, cellulose, cloth, or polymer. The polymer can be polypropylene, polyethylene terephthalate (PET), polyetherimide (PEI), polyethylene naphthalate (PEN), polyphenylene sulfide (PPS), polyvinyl chloride (PVC), polystyrene (PS), or polyethersulfone (PES). The material of the membrane 152 can also be glass fiber, bakelite, silk fiber, expanded polystyrene (EPS), or expanded plastic.

The base 142 may be made of polyimide, polyester, aluminum, fiberglass, or paper. The base 142 may have a lighter weight and higher specific strength. In one embodiment, the base 142 is a polyimide film. The polyimide film has a small density of about 1.35 g/cm$^3$, to decrease the weight of the voice coil bobbin 140 and increase the specific strength thereof.

The first reinforcing structure 154 and the second reinforcing structure 144 are a carbon nanotube structure covering outer surfaces of the membrane 152 and the base 142. In other words, the carbon nanotube structure lays on the outer surfaces of the membrane 152 and the base 142. Accordingly, one part of the carbon nanotube structure laying on the membrane 152 is named the first reinforcing structure 154. Another part of the carbon nanotube structure laying on the base 142 is named the second reinforcing structure 144. The carbon nanotube structure wraps around the outer circumferential surface of the base 142.

In one example, the carbon nanotube structure can include at least one carbon nanotube film described above. If more than one carbon nanotube film is used they can be stacked together or coplanarly arranged on outer surfaces of the membrane 152 and the base 142.

In another example, the carbon nanotube structure includes a plurality of carbon nanotube wire structures.

Figure 10:
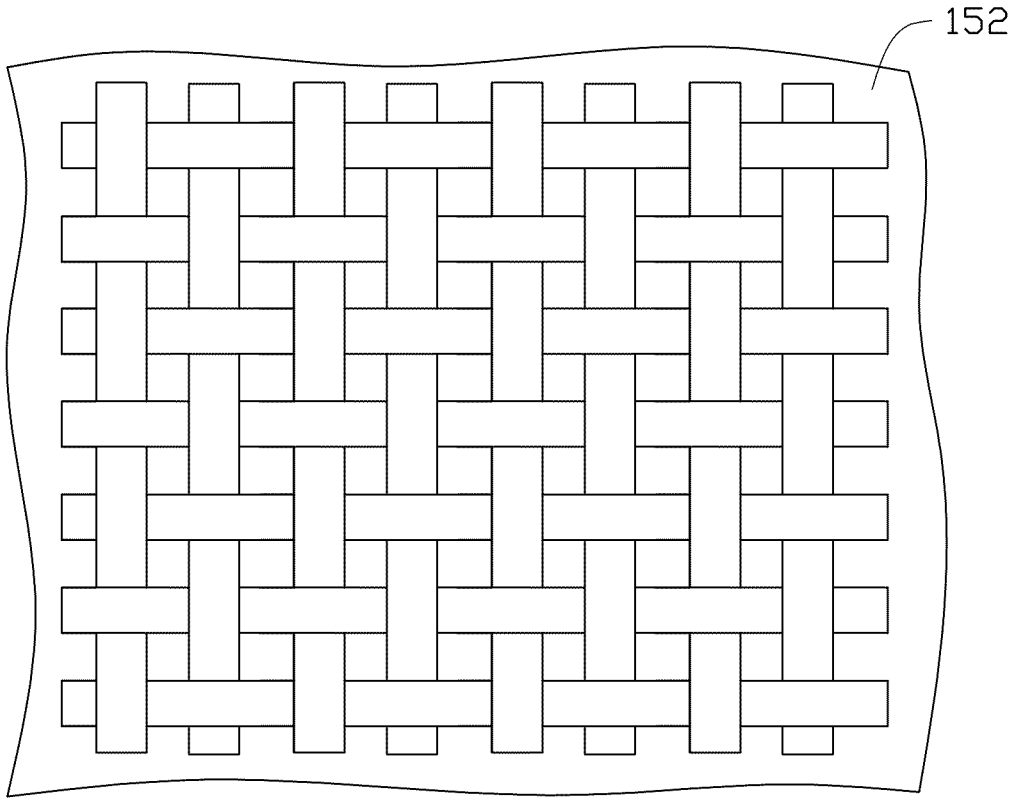
FIG. 10 is a schematic top view of an embodiment of a diaphragm including a plurality of carbon nanotube wire structures woven together.
Figure 11:
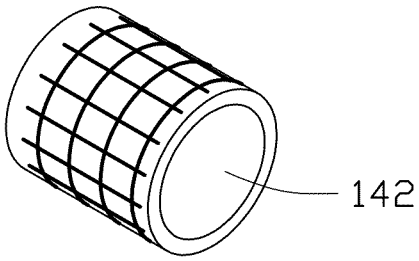
FIG. 11 is a schematic structural view of an embodiment of a bobbin fixable to the diaphragm of FIG. 10.

As shown in FIGS. 10 and 11, the plurality of carbon nanotube wire structures can be crossed with each other or woven together, and positioned on the outer surfaces of the membrane 152 and the base 142. Specifically, the plurality of carbon nanotube wire structures can be firstly crossed with each other or woven together to form a planer shaped structure, and then the planer shaped structure can be disposed on the outer surfaces of the membrane 152 and the base 142 by an adhesive or a hot pressing method.

Figure 12:
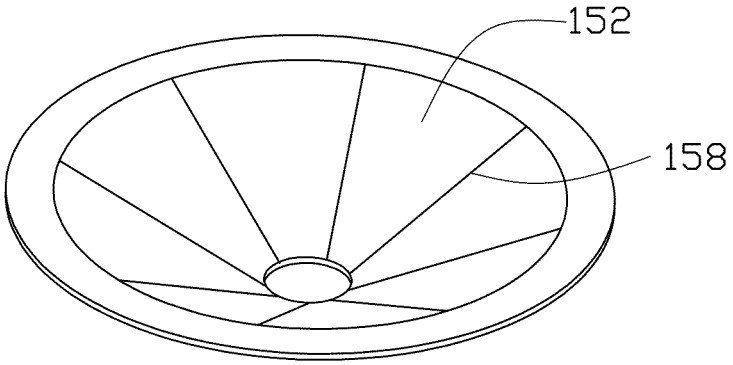
FIG. 12 is a schematic structural view of another embodiment of a diaphragm including a plurality of radiated arranged carbon nanotube wire structures.
Figure 13:
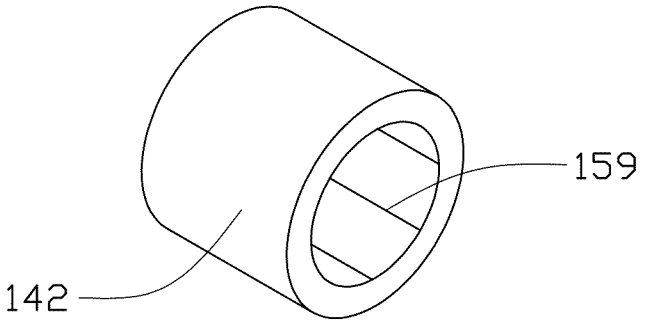
FIG. 13 is a schematic structural view of an embodiment of a bobbin fixable to the diaphragm of FIG. 12.

As shown in FIGS. 12 and 13, each of the carbon nanotube wire structures comprises a first portion 158 on the membrane 152 and a second portion 159 on the base 142. The first portions 158 are arranged on the surface of the membrane 152, and extend radially from a central area towards a peripheral edge of the membrane 152. The second portions 159 extend from ends of the first portions 158, and are disposed substantially parallel to each other on an inner surface of the base 142.

In another example, the carbon nanotube structure includes a plurality of carbon nanotube wire structures and a plurality of base wires. The carbon nanotube wire structures and the base wires can be crossed with each other or woven together and placed on the outer surfaces of the membrane 152 and the base 142 in a manner similar to or the same as that shown in FIGS. 10 and 11.

Figure 14:
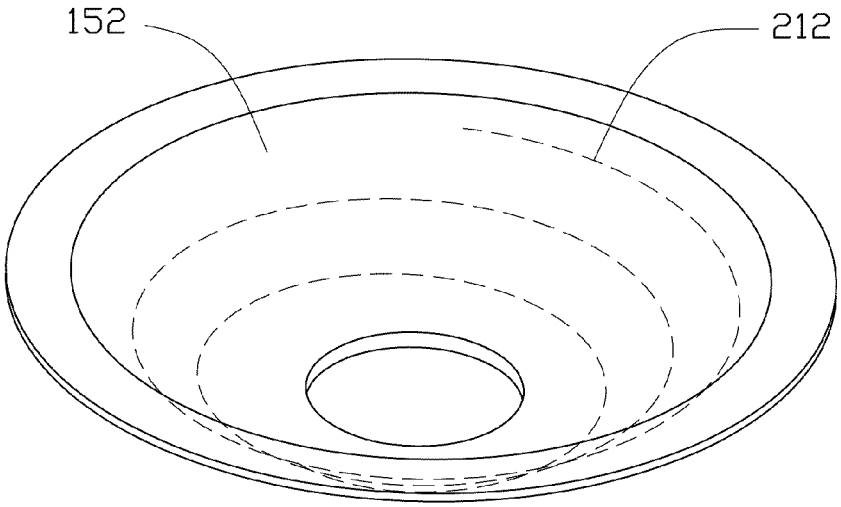
FIG. 14 is a schematic structural view of another embodiment of a diaphragm including a single linear carbon nanotube structure which is disposed on a lower surface thereof.
Figure 15:
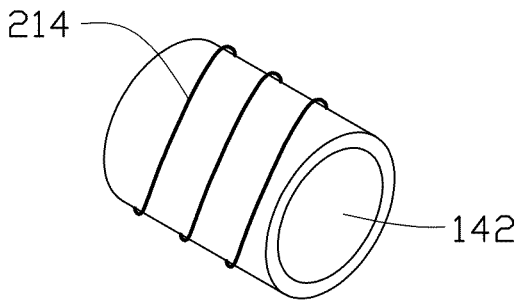
FIG. 15 is a schematic structural view of an embodiment of a bobbin fixable to the diaphragm of FIG. 14.

In another example, the carbon nanotube structure can be a single linear carbon nanotube structure. As shown in FIGS. 14 and 15, the single linear carbon nanotube structure comprises a first portion 212 on the membrane 152 and a second portion 214 on the surface of the base 142. The first portion 212 is arranged on the surface of the membrane 152 in a spiral shape. The second portion 214 extends from the first portion 212 and wraps around the surface of the base 142 in a helix-like pattern.

Example 2

Carbon Nanotube Structure in Diaphragm and Voice Coil Bobbin

In this example, the diaphragm and the voice coil bobbin comprise at least one carbon nanotube structure. This example is similar to that shown in FIG. 9, except that the carbon nanotube structure is located in the diaphragm and the voice coil bobbin.

Figure 16:
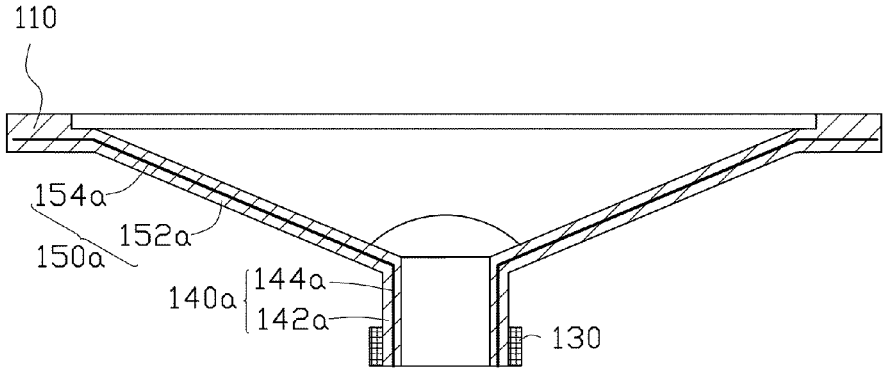
FIG. 16 is similar to FIG. 9, except that a carbon nanotube structure is disposed in a diaphragm and a voice coil bobbin.

As shown in FIG. 16, the diaphragm 150*a* comprises a membrane 152*a* and a first reinforcing structure 154*a* in the membrane 152*a*. The voice coil bobbin 140*a* comprises a base 142*a* and a second reinforcing structure 144*a* in the base 142*a*.

The first reinforcing structure 154*a* and the second reinforcing structure 144*a* are a carbon nanotube structure which is located in the membrane 152*a* and the base 142*a*. One part of the carbon nanotube structure located in the membrane 152*a* is named the first reinforcing structure 154*a*. Another part of the carbon nanotube structure located in the base 142*a* is named the second reinforcing structure 144*a*.

In one example, the carbon nanotube structure can include at least one carbon nanotube film described above. If using more than one carbon nanotube film, the films can be stacked together or coplanarly arranged in the membrane 152*a* and the base 142*a*.

In another example, the carbon nanotube structure includes a plurality of carbon nanotube wire structures.

Figure 17:
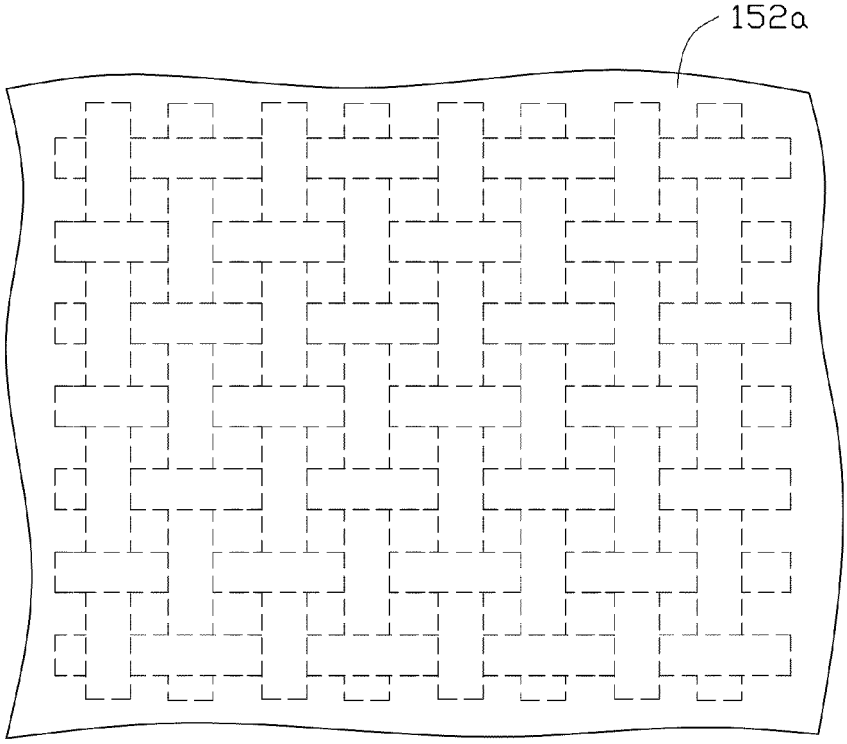
FIG. 17 is similar to FIG. 10, except that a carbon nanotube structure is disposed in a membrane.
Figure 18:
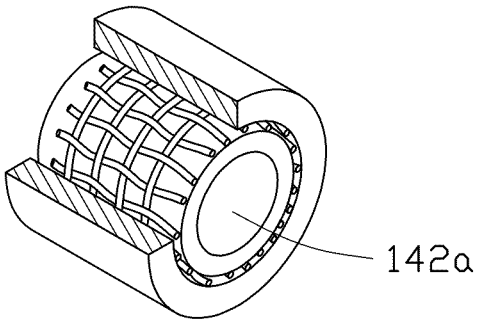
FIG. 18 is similar to FIG. 1, except that a carbon nanotube structure is disposed in a base.

As shown in FIGS. 17 and 18, the plurality of carbon nanotube wire structures can be crossed with each other or woven together, and positioned in the membrane 152*a* and the base 142*a*.

Figure 19:
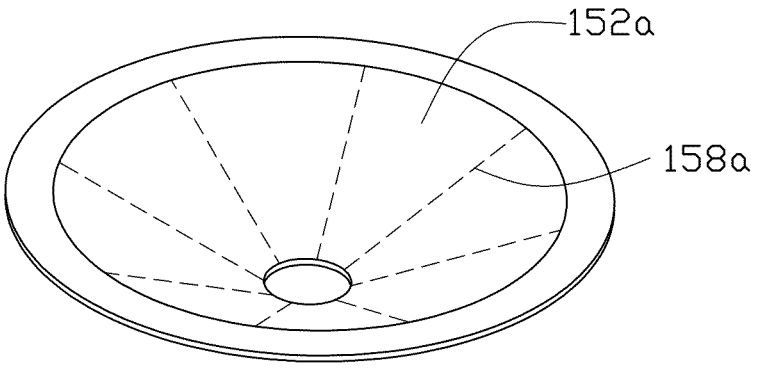
FIG. 19 is similar to FIG. 12, except that a carbon nanotube structure is disposed in a membrane.
Figure 20:
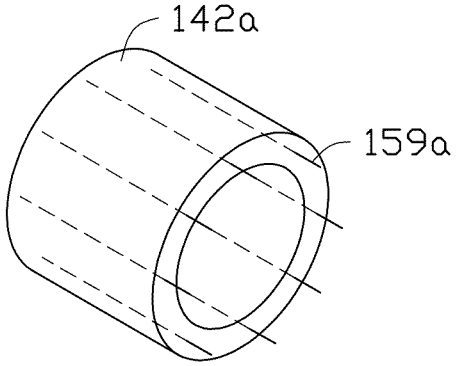
FIG. 20 is similar to FIG. 13, except that a carbon nanotube structure is disposed in a base.

As shown in FIGS. 19 and 20, each of the carbon nanotube wire structures comprises a first portion 158*a* in the membrane 152*a* and a second portion 159*a* in the base 142*a*. The first portions 158*a* are arranged in the membrane 152*a*, and extend radially from a central area towards a periphery edge of the membrane 152*a*. The second portions 159*a* extend from ends of the first portions 158*a*, and are substantially disposed in parallel with each other in the base 142*a*.

In another example, the carbon nanotube structure includes a plurality of carbon nanotube wire structures and a plurality of base wires. The carbon nanotube wire structures and the base wires can be crossed with each other or woven together, and placed in the membrane 152*a* and the base 142*a*, in a manner similar or same to that shown in FIGS. 17 and 18.

Figure 21:
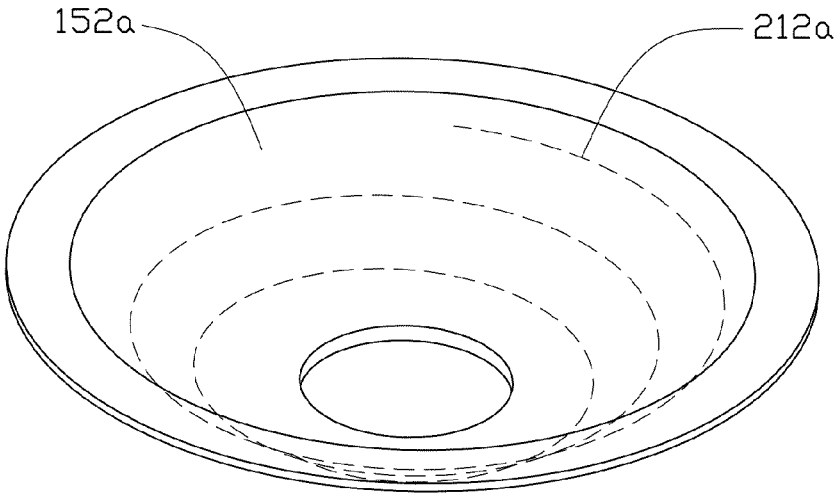
FIG. 21 is similar to FIG. 14, except that a single linear carbon nanotube structure is disposed in a membrane.
Figure 22:
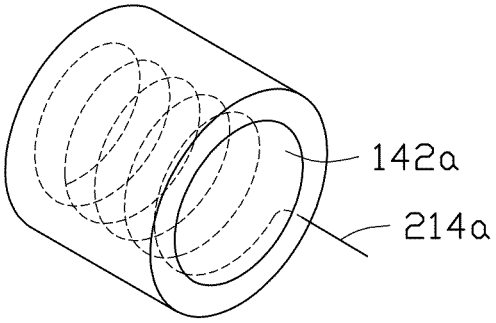
FIG. 22 is similar to FIG. 15, except that a carbon nanotube structure is disposed in a base.

In another example, the carbon nanotube structure can be a single linear carbon nanotube structure. As shown in FIGS. 21 and 22, the single linear carbon nanotube structure comprises a first portion 212*a* in the membrane 152*a* and a second portion 214*a* in the base 142*a*. The first portion 212*a* is arranged in the membrane 152*a* in a spiral shape. The second portion 214*a* extends from the first portion 212*a* and is located in the base 142*a* like a helix.

According to the above descriptions, the loudspeaker of the present disclosure has the following advantages.

(1) Because carbon nanotubes have good physical properties, the carbon nanotube structure provided in the diaphragm and the voice coil bobbin can increase the physical properties of loudspeaker, such as the strength and the elasticity of the loudspeaker. Therefore, the sound quality of the loudspeaker, particularly the sound volume, can be increased.

(2) The carbon nanotube structure can decrease the weight of the diaphragm and the voice coil bobbin under the same volume. This can help to improve the conversion efficiency of the energy.

(3) The carbon nanotube structure extends from the diaphragm to the voice coil bobbin, which can help to increase the bonding strength between the diaphragm and the voice coil bobbin, particularly if the diaphragm and the voice coil bobbin are separately fabricated.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A loudspeaker comprising:

a diaphragm comprising a membrane and a first reinforcing structure reinforcing the membrane; and a voice coil bobbin comprising a base connected to the diaphragm and a second reinforcing structure reinforcing the base;

a voice coil located around an outer suface of the voice coil bobbin;

wherein the first reinforcing structure and the second reinforcing structure are a carbon nanotube structure comprising a plurality of carbon nanotubes combined with each other.

2. The loudspeaker of claim 1, wherein the carbon nanotube structure lays on and resembles outer surfaces of the membrane and the base; one part of the carbon nanotube structure laying on the membrane forms the first reinforcing structure, and another part of the carbon nanotube structure laying on the base forms the second reinforcing structure.

3. The loudspeaker of claim 2, wherein the second reinforcing structure wraps around the outer circumferential surface of the base.

4. The loudspeaker of claim 2, wherein the carbon nanotube structure comprises a drawn carbon nanotube film, a flocculated carbon nanotube film, or a pressed carbon nanotube film.

5. The loudspeaker of claim 4, wherein the carbon nanotube structure comprises a plurality of carbon nanotube films stacked together or coplanarly arranged on the outer surfaces of the membrane and the base.

6. The loudspeaker of claim 2, wherein the carbon nanotube structure comprises a plurality of carbon nanotube wire structures.

7. The loudspeaker of claim 6, wherein the plurality of carbon nanotube wire structures are crossed with each other or woven together, and positioned on the outer surfaces of the membrane and the base.

8. The loudspeaker of claim 6, wherein each of the plurality of carbon nanotube wire structures comprises a first portion disposed on the membrane and a second portion disposed on the base; the first portions are arranged on a surface of the membrane and extend radially from a central area of the membrane towards a periphery edge of the membrane, and the second portions extend from ends of the first portions and are disposed substantially parallel on a surface of the base.

9. The loudspeaker of claim 6, wherein the carbon nanotube structure further comprises a plurality of base wires; the plurality of carbon nanotube wire structures and the plurality of base wires are crossed with each other or woven together, and placed on the outer surfaces of the membrane and the base.

10. The loudspeaker of claim 2, wherein the carbon nanotube structure is a single linear carbon nanotube structure comprising a first portion on the membrane and a second portion on the surface of the base; the first portion is arranged on the surface of the membrane in a spiral shape, and the second portion extends from the first portion and wraps around the surface of the base in a helix shape.

11. The loudspeaker of claim 1, wherein the carbon nanotube structure is located in the diaphragm and the voice coil bobbin; one part of the carbon nanotube structure laying in the membrane forms the first reinforcing structure, and another part of the carbon nanotube structure laying in the base forms the second reinforcing structure.

12. The loudspeaker of claim 11, wherein the second reinforcing structure wraps around the outer circumferential surface of the base.

13. The loudspeaker of claim 12, wherein the carbon nanotube structure comprises a drawn carbon nanotube film, a flocculated carbon nanotube film, or a pressed carbon nanotube film.

14. The loudspeaker of claim 12, wherein the carbon nanotube structure comprises a plurality of carbon nanotube wire structures.

15. The loudspeaker of claim 14, wherein the plurality of carbon nanotube wire structures are crossed with each other or woven together and positioned on the outer surfaces of the membrane and the base.

16. The loudspeaker of claim 14, wherein each of the plurality of carbon nanotube wire structures comprises a first portion disposed on the base; the first portions are arranged on a surface of the membrane and extend radially from a central area of the membrane towards a periphery edge of the membrane, and the second portions extend from ends of the first portions and are disposed substantially parallel on a surface of the base.

17. The loudspeaker of claim 12, wherein the carbon nanotube structure further comprises a plurality of base wires; the plurality of carbon nanotube wire structures and the plurality of base wires are crossed with each other or woven together, and placed on the outer surfaces of the membrane and the base.

18. The loudspeaker of claim 12, wherein the carbon nanotube structure is a single linear carbon nanotube structure comprising a first portion on the membrane and a second portion on the surface of the base; the first portion is arranged on the surface of the membrane in a spiral shape, and the second portion extends from the first portion and wraps around the surface of the base in a helix shape.

19. A loudspeaker comprising:

a membrane;

a voice coil bobbin connected to the membrane, the voice coil bobbin comprising a base and a carbon nanotube structure; and the carbon nanotube structure wrapping around an outer circumferential surface of the base, wherein the carbon nanotube structure comprises a plurality of carbon nanotubes combined with each other.

* * * * *